US009072341B2

(12) United States Patent
Jungkind

(10) Patent No.: US 9,072,341 B2
(45) Date of Patent: Jul. 7, 2015

(54) ROTARY CLOSURE FOR A SHOE

(71) Applicant: PUMA SE, Herzogenaurach (DE)

(72) Inventor: Roland Jungkind, Garmisch-Partenkirchen (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 14/400,628

(22) PCT Filed: Nov. 30, 2012

(86) PCT No.: PCT/EP2012/004984

§ 371 (c)(1),
(2) Date: Nov. 12, 2014

(87) PCT Pub. No.: WO2014/082652

PCT Pub. Date: Jun. 5, 2014

(65) Prior Publication Data

US 2015/0121669 A1 May 7, 2015

(51) Int. Cl.

| | |
|---|---|
| ***A43C 11/16*** | (2006.01) |
| *A43C 11/20* | (2006.01) |
| *A43C 11/00* | (2006.01) |

(52) U.S. Cl.

CPC ..... *A43C 11/16* (2013.01); *A43C 11/165* (2013.01); *Y10T 24/2183* (2015.01); *Y10T 24/2187* (2015.01); *Y10T 24/3724* (2015.01); *A43C 11/20* (2013.01); *A43C 11/004* (2013.01)

(58) Field of Classification Search

CPC ..... A43C 11/165; A43C 11/16; A43C 7/00; A43C 1/00

USPC ..... 2/417, 418; 24/16 R, 20 TT, 68 B, 68 R, 24/68 SK, 115 R, 712, 712.1, 712.2, 712.7, 24/712.9, 713.2, 715.3, 909, 712.5, 71.1, 24/132 R, 132 AA, 712.4, 712.6; 242/378, 242/378.1–378.4, 388, 388.1–388.5, 385, 242/385.4; 254/222, 223, 238, 239; 36/50.1

See application file for complete search history.

(56) References Cited

U.S. PATENT DOCUMENTS

| | | | | |
|---|---|---|---|---|
| 2,926,406 | A * | 3/1960 | Edwards et al. | 24/68 B |
| 4,433,456 | A * | 2/1984 | Baggio | 24/68 SK |
| 4,633,599 | A * | 1/1987 | Morell et al. | 242/388.1 |
| 5,117,567 | A * | 6/1992 | Berger | 36/50.1 |

(Continued)

FOREIGN PATENT DOCUMENTS

| | | |
|---|---|---|
| DE | 29701491 U1 | 5/1998 |
| WO | 9833408 A1 | 8/1998 |

*Primary Examiner* — Robert J Sandy
*Assistant Examiner* — Rowland Do
(74) *Attorney, Agent, or Firm* — Lucas & Mercanti, LLP

(57) ABSTRACT

A rotary closure for a shoe, especially for a sports shoe, including a housing which can be attached to the shoe, a tensioning roller which is rotatably supported around an axis in the housing, wherein a tensioning element can be spooled during lacing of the shoe on the tensioning roller and a rotary knob which is arranged rotatable around the axis at the housing to turn the tensioning roller. The rotary closure furthermore includes an intermediate carrier, wherein the intermediate carrier has at least one pawl which engages in a first blocking gearing of the housing and at least one locking lever which is arranged in or at the intermediate carrier, wherein a first and a second control element which co-operate with first and second crank section of the locking lever, are disposed on the rotary knob.

19 Claims, 3 Drawing Sheets

(56) References Cited

U.S. PATENT DOCUMENTS

| | | | | |
|---|---|---|---|---|
| 5,177,882 | A * | 1/1993 | Berger | 36/50.1 |
| 7,174,575 | B1 * | 2/2007 | Scherer | 2/418 |
| 7,367,522 | B2 * | 5/2008 | Chen | 242/378.1 |
| 7,584,528 | B2 * | 9/2009 | Hu | 24/68 SK |
| 7,854,024 | B2 * | 12/2010 | Fang | 2/418 |
| 7,900,670 | B2 * | 3/2011 | McCauley et al. | 152/219 |
| 8,231,074 | B2 * | 7/2012 | Hu et al. | 242/388.1 |
| 8,245,371 | B2 * | 8/2012 | Chen | 24/712.9 |
| 8,353,087 | B2 * | 1/2013 | Chen | 24/68 SK |
| 8,381,362 | B2 * | 2/2013 | Hammerslag et al. | 24/68 SK |
| 8,434,200 | B2 * | 5/2013 | Chen | 24/68 SK |
| 8,468,657 | B2 * | 6/2013 | Soderberg et al. | 24/68 SK |
| 8,516,662 | B2 * | 8/2013 | Goodman et al. | 24/68 SK |
| 8,832,912 | B2 * | 9/2014 | Ha | 24/712.9 |
| 8,858,482 | B2 * | 10/2014 | Ingimundarson et al. | 602/27 |
| 2003/0093882 | A1 * | 5/2003 | Gorza et al. | 24/68 SK |
| 2007/0084956 | A1 * | 4/2007 | Chen | 242/388.6 |
| 2008/0172848 | A1 * | 7/2008 | Chen | 24/68 SK |
| 2011/0266384 | A1 | 11/2011 | Goodman et al. | |
| 2014/0290014 | A1 * | 10/2014 | Myrick | 24/712.2 |
| 2014/0290016 | A1 * | 10/2014 | Lovett et al. | 24/713.5 |
| 2015/0007422 | A1 * | 1/2015 | Cavanagh et al. | 24/68 SK |

* cited by examiner

ROTARY CLOSURE FOR A SHOE

The present application is a 371 of International application PCT/EP2012/004984, filed Nov. 30, 2012, the priority of this application is hereby claimed and this application is incorporated herein by reference.

BACKGROUND OF THE INVENTION

The invention relates to a rotary closure for a shoe, especially for a sports shoe, comprising: a housing which can be attached to the shoe, a tensioning roller which is rotatable supported around an axis in the housing, wherein a tensioning element can be spooled during lacing of the shoe on the tensioning roller and a rotary knob which is arranged rotatable around the axis at the housing to turn the tensioning roller. Furthermore, the invention relates to a shoe with such a rotary closure.

A rotary closure of the generic kind is for example known DE 297 01 491 U1. Such a rotary closure should allow the lacing of a shoe at the one hand during lacing of the tensioning element (lace thread or wire) by rotating of the rotary knob with low torque and still high tension. At the other hand also an easy slacking of the tensioning element should also be possible when the shoe should be taken off again.

Further important aspects are a light weight of the rotary closure and a cost-efficient production with as few parts as possible.

Rotary closures with a complex mechanics became known to make the slacking of the tensioning element possible in an easy manner. For example, the rotary knob was already arranged pivotable respectively foldaway at the housing, wherein after the pivoting respectively swiveling of the rotary knob a de-latching of the tensioning roller takes place so that the tightened tensioning element becomes free of tension. At other solutions a press button can be activated to carry out the de-latching of the tensioning roller.

At other different kinds of rotary closures planetary gears are employed for the gear reduction of the rotary movement of the rotary knob to reach said aims.

It is detrimental at the known systems that the mentioned requirements cannot be fulfilled collectively without problems. Rotary closures which fulfill the mechanical requirements are often designed so complex that an expensive production with relatively many parts is given.

SUMMARY OF THE INVENTION

It is the object of the invention to further develop a rotary closure of the generic kind so that at the one hand an easy but also strong tension of the tensioning element is given during the closing of the rotary closure and that at the other hand an easy releasing respectively de-latching of the tensioning element is possible. Simultaneously, a light construction is aimed for and a cost-efficient production with few parts should be realized.

The solution of this object by the invention is characterized in that the rotary closure according to the kind mentioned above furthermore comprises:

an intermediate carrier which is arranged rotatable around the axis in the housing, wherein the intermediate carrier comprises at least one pawl which engages in a first blocking gearing which is arranged at or in the housing so that the intermediate carrier can only rotate in one direction of rotation relatively to the housing, at least one locking lever which is arranged in or at the intermediate carrier and which is supported pivoting around an axis which is parallel to the axis in or at the intermediate carrier, wherein the locking lever comprises a locking section which is designed to engage in a second blocking gearing in a first swivel position of the locking lever, which second blocking gearing is arranged at the tensioning roller, and which is further designed not to engage in the second blocking gearing in a second swivel position of the locking lever, wherein a first control element and a second control element are arranged at the rotary knob, wherein the first control element can engage in a first crank section of the locking lever at the rotation of the rotary knob in a first direction of rotation to move the locking lever into the first swivel position and to turn the intermediate carrier together with the tensioning roller, and wherein the second control element can engage in a second crank section of the locking lever at the rotation of the rotary know in a second direction of rotation which is contrawise to the first direction of rotation to move the locking lever into the second swivel position.

The housing has preferably a cylindrical shape.

The first blocking gearing is preferably formed into an inner circumference of the housing. This inner circumference is thereby preferably formed cylindrically. The housing can thereby consists of plastic material, wherein the first blocking gearing is formed into the material of the housing.

The second blocking gearing and the tensioning roller are preferably formed as a one-piece part, especially as injection moulded part.

The axis of rotation for the parts which are movable respectively rotatable supported relatively to the housing is preferably realized by a bolt. Here, especially a screw bolt (screw) is considered.

The tensioning element is mostly a tensioning wire.

The two control elements are preferably formed at the rotary knob as pencil-shaped protrusions, especially as cylindrical formed protrusions. The two control elements can thereby be arranged at the same diameter from the axis and offset in circumferential direction.

The intermediate carrier comprises preferably two pawls which are arranged at the intermediate carrier diametrically with respect to the axis. The at least one pawl can thereby be arranged as an elastic section radially to the axis at the intermediate carrier. The pawl can furthermore extend as substantially straight tongue-shaped section substantially in circumferential direction of the intermediate carrier.

The intermediate carrier consists due to production reasons preferably of a sheet-metal part at which the pawls are formed from the material of the intermediate carrier.

The locking lever consists preferably of metal.

A bearing bolt can be arranged at the locking lever protruding in the direction of the axis which is supported in a recess in the intermediate carrier.

Thereby, preferably a single locking lever is arranged at or in the intermediate carrier.

The rotary knob can comprise a recess at a circumferential position eccentrically from the axis, i. e. remote from the axis, especially a circular shaped recess; the intermediate carrier can comprise a marking at its side facing the rotary knob, wherein the marking is visible through the recess when the rotary knob is located with its second control element in the second crank section of the locking lever and the locking lever it located thus in the second swivel position. By doing so it is possible to recognize the positioning of the rotary knob when the rotary closure is in the de-latched position and the tensioning element (tensioning wire) is consequently slacked for taking off the shoe. The marking is thereby preferably designed as a colour point.

Furthermore, the invention relates to a shoe, especially a sport shoe, with a rotary closure of the described kind.

Accordingly, the proposed rotary closure thus comprises a housing in which the tensioning roller (spool wheel) for the tensioning element (wire) is rotatable supported, namely around the central axis. The tensioning roller is provided with a ratchet (second blocking gearing) which allows a rotation in one direction of rotation, however this rotation prevents when the locking lever is engaged. The locking lever is rotatable supported in the intermediate carrier (carrier element) which is rotatable supported around the central axis, namely around a swivel axis which is arranged parallel to the central axis but distanced from the same. The intermediate carrier can be rotated around the central axis—for tensioning of the wire—but only in tensioning direction what is achieved by pawls (spring tongues) which are arranged elastically radial to the outer side at the intermediate carrier and which engage in the first blocking gearing (catch profile) which is machined at the inner side of the edge of the housing.

The rotary knob (lid) which is rotatable supported around the central axis comprises the two control elements (cams). The first control element engages in the intermediate carrier during tensioning of the wire (rotation into direction R1) and rotates the same together with the locking lever in the closing direction. A turn back of the tensioning roller is thereby prevented because the locking section (hook section) of the locking lever engages into the second blocking gearing of the tensioning roller and thus hinders the tensioning roller from turning back.

If the rotary knob (lid) is turned in the direction against the tensioning direction (direction of rotation R2) the second pawl element (cam) presses against the cam-like formed section (second crank section) of the locking lever so that the same is rotated around the swivel axis in such a manner that the locking section (hook section) is brought out of engagement with the second blocking gearing (ratchet) of the tensioning roller; now, the spooled wire can be pulled off the tensioning roller which can now rotate freely.

Beneficially, a simple design with few parts is obtained which not only keeps the production costs of the rotary closure low but also minimizes the weight of the rotary closure.

The geometrical forming of the parts, especially of the tensioning roller, allows that a high tensioning force in the tensioning element is reached with low torques at the rotary knob when the shoe respectively the tensioning element is tensioned.

However, it is possible by turning back of the rotating knob against the tensioning direction of rotation to establish a de-latched status in which the tensioning element can be drawn off from the tensioning roller.

In the drawing an embodiment of the invention is depicted. It shows:

DETAILED DESCRIPTION OF THE INVENTION

Figure 1:
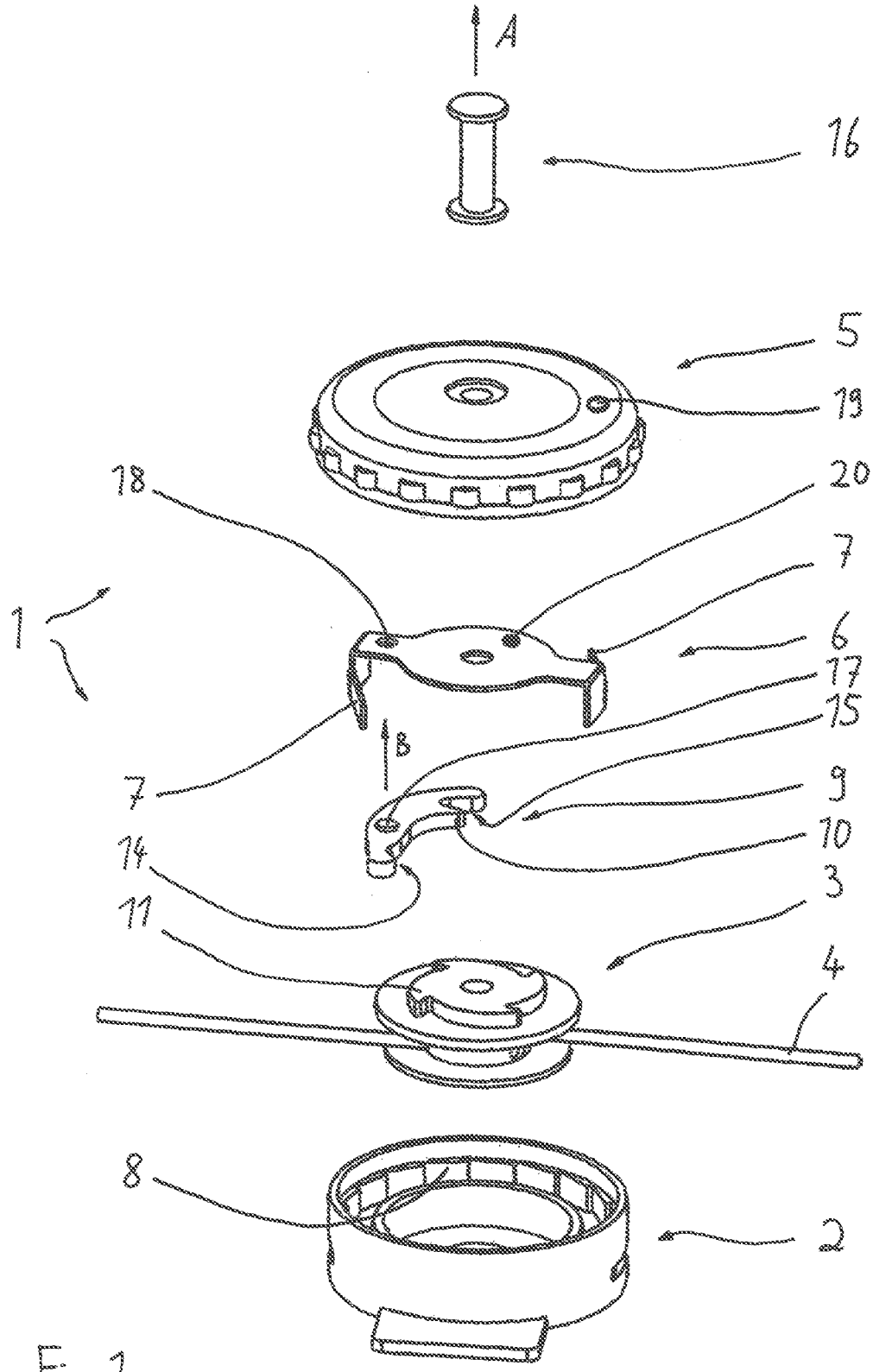
FIG. 1 in explosion view a rotary closure for a sports shoe.

In the figures a rotary closure 1 can be seen which can be attached for example to the instep of a shoe to serve for lacing of the shoe; but also other locations for attachment are possible, for example in the lateral region or in the heel region of the shoe.

The rotary closure 1 comprises a cylindrical housing 2 which consists of plastic material and is equipped with a first blocking gearing 8 at an inner cylindrical area. By means of a bolt 16 (for example a screw with a closure in the end region by means of a screw nut) a central axis A is formed by which different rotatable parts of the rotary closure 1 are supported.

At first a tensioning roller 3 is freely rotatable supported in the housing 2. A tensioning wire respectively tensioning element 4 can be spooled on the tensioning roller 3, namely in known manner so that during spooling the shoe is tensioned respectively laced at the foot of the wearer.

At the upper side of the tensioning roller 3 a second blocking gearing 11 is formed. The tensioning roller 3 consists also of plastic material so that the blocking gearing 11 is formed by the injection molding process of the form part.

An intermediate carrier 6 is arranged on the tensioning roller 3 and also supported around the axis A which consists of a punched and deformed sheet metal part. The intermediate carrier 6 comprises two pawls 7 which are provided and designed for the engagement in the first blocking gearing 8. Accordingly, the intermediate carrier 6 can rotate relatively to the housing 2 in only one direction of rotation (namely in the direction of rotation R1, see FIG. 2); the opposite rotation is prevented by the pawls 7 which engage in the first blocking gearing 8.

A locking lever 9 made of metal (steel) is arranged between the tensioning roller 3 and the intermediate carrier 6. The locking lever has a bearing bolt 17 which fits into a recess 18 which is machined into the intermediate carrier 6.

Thus, the locking lever 9 can swivel relatively to the intermediate carrier 6 around an axis B which is parallel to the axis A but distanced from the same and can namely take two swivel positions:

In a first swivel position I (see FIG. 2) the locking lever 9 engages with a hook-shaped locking section 10 in the second blocking gearing 11. In this position the tensioning roller 3 can be rotated only in tensioning direction R1. However, the tensioning element 4 which is spooled on it cannot be unwound so that the tensioning element 4 is kept under tension.

In a second swivel position II (see FIG. 3) the locking section 10 is brought out of engagement with the second blocking gearing 11. Accordingly, now the tensioning roller 3 can rotate freely around the axis A so that the spooled tensioning element 4 can be unwound.

Above the intermediate carrier 6 the rotary knob 5 is rotatable arranged around the axis A. The rotary knob 5 has two control elements at its bottom side which is not visible in FIG. 1 which control elements extend in the direction of the axis A respectively B, namely a first control element 12 and a second control element 13. In the depictions according to the FIGS. 2 and 3 the position of the two control elements 12 and 13 can be seen. Both control elements are—which is preferred—designed as cylindrical sections protruding in the direction from the axis A from the rotary knob 5 in the embodiment. Thereby, they are provided to cooperate alternatively with two crank sections 14 and 15 of the locking lever 9.

Figure 2:
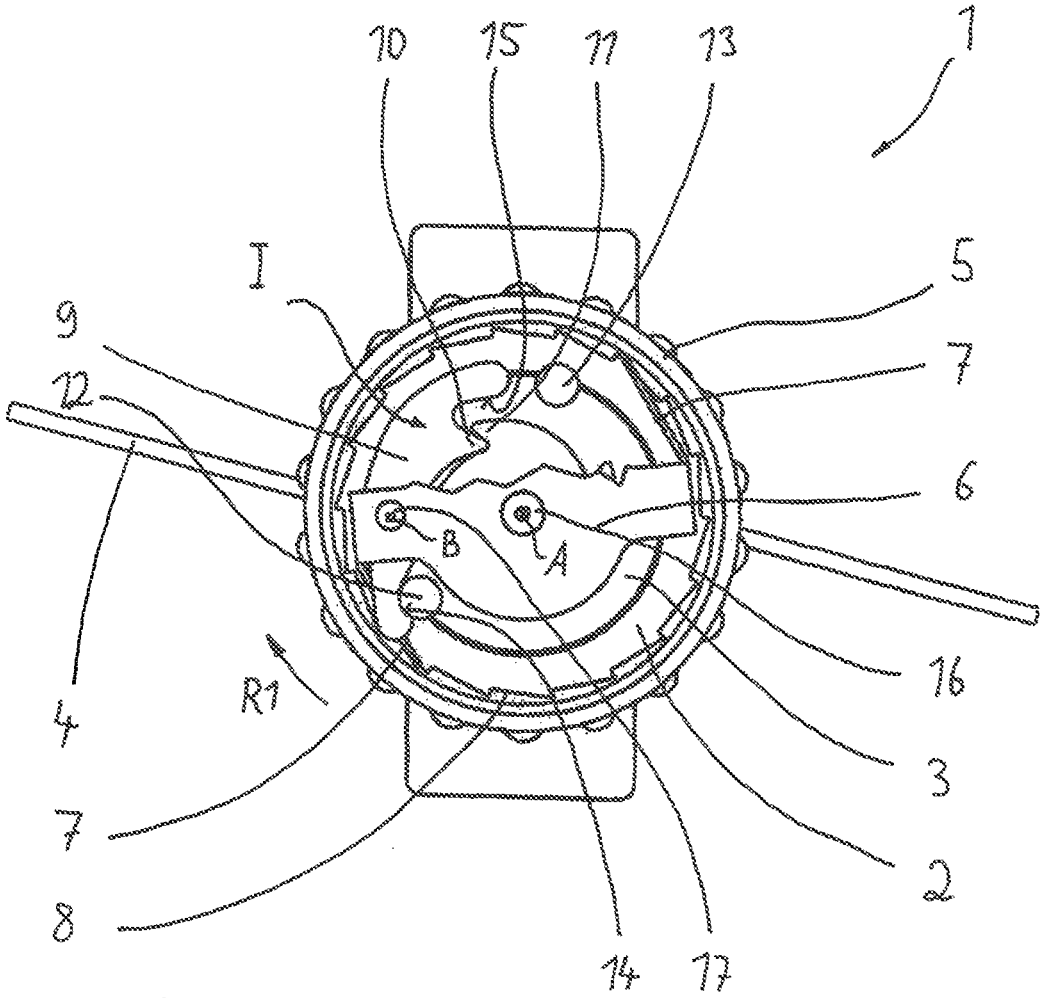
FIG. 2 a section through the rotary closure which runs perpendicular to the axis of rotation of the rotary closure, wherein a locked status of the rotary closure is shown, and FIG. 3 the section according to FIG. 2, wherein a released status of the rotary closure is shown.

As it can be seen in FIG. 2 the rotary knob 5 is rotated in the first direction of rotation R1 during tensioning of the tensioning element 4, i. e. during spooling of the same onto the tensioning roller 3. The first control element 12 is pressed by the rotation of the rotary knob 5 into the first crank section 14, for which reason the locking lever 9 takes the first swivel position I and accordingly the locking section 10 engages in the second blocking gearing 11.

Thus, during rotation of the rotary knob 5 in the direction R1 not only a de-spooling of the tensioning element 4 from the tensioning roller 3 is prevented. Rather the rotary knob 5 takes with it via the first control element 12 the intermediate carrier 6 together with the locking lever 9 as well as (by means of the locking section 10) the tensioning roller 3 in the direction of rotation R1 so that the tensioning element 4 is spooled on the tensioning roller 3 and the tensioning roller 3 is incidentally hindered from turning back (said turning back is prevented by the pawls 7 at the intermediate carrier 6).

Figure 3:
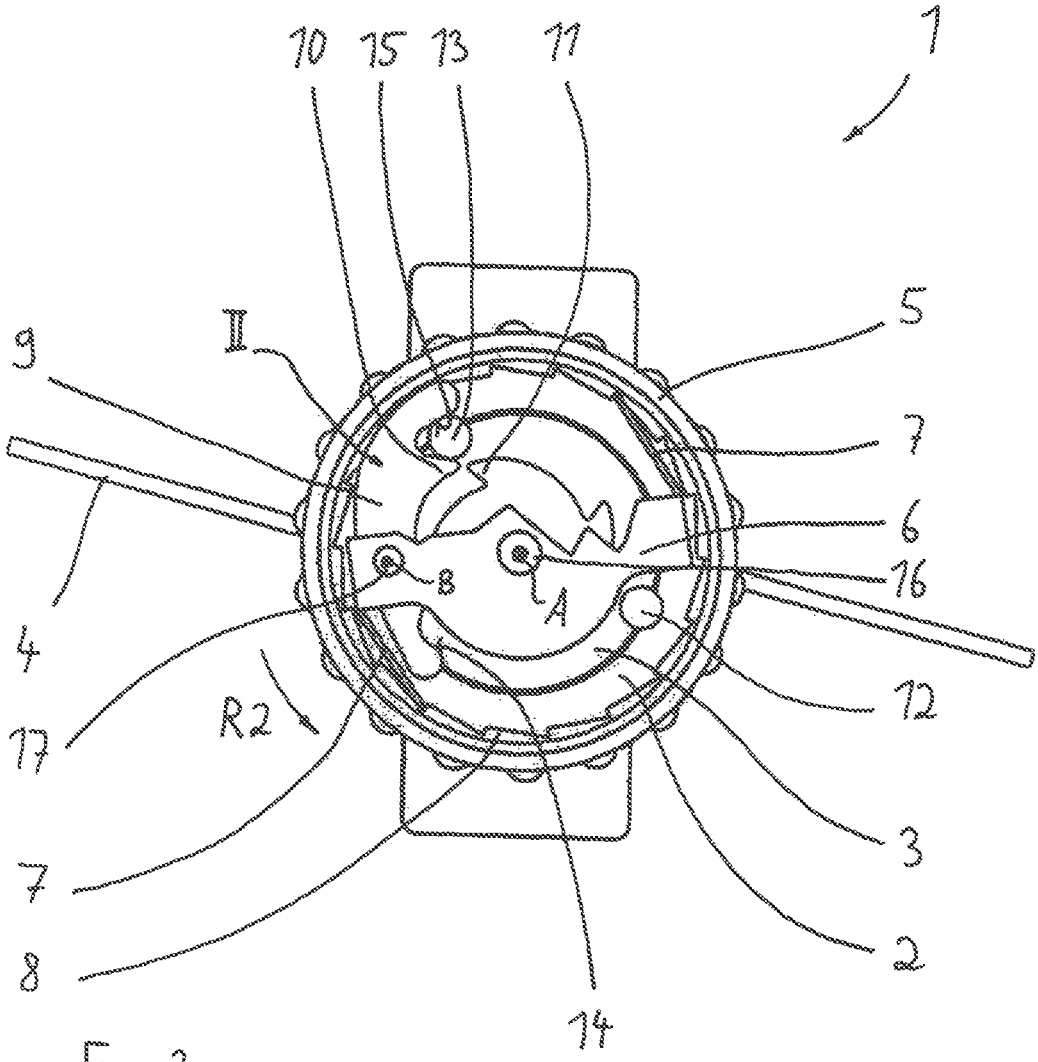

However, during the rotation of the rotating knob 5 in the opposite direction of rotation R2 the second control element 13 is—as shown in FIG. 3—pressed in the second crank section 15 which brings the locking lever 9 in the second swivel position II. The locking section 10 gets out of engagement with the second blocking gearing 11 so that the tensioning roller 3 is now freely rotatable and the spooled tensioning element 4 can be pulled off respectively de-spooled.

In the rotary knob 5 a recess 19 is provided, at the intermediate carrier 6 a colored marking 20 (see FIG. 1). Via this element it can be made visible for the user immediately if the rotary closure is located in the de-latched position, i. e. the locking lever 9 is in the second swivel position II. When the color marking 20 becomes visible in the recess 19 the user knows that he has turned the rotary knob 5 sufficiently in the second direction of rotation R2 so that the de-latched position of the rotary closure is reached.

LIST OF REFERENCES

1 Rotary Closure
2 Housing
3 Tensioning roller
4 Tensioning element
5 Rotary knob
6 Intermediate carrier
7 Pawl
8 First blocking gearing
9 Locking lever
10 Locking section
11 Second blocking gearing
12 First control element
13 Second control element
14 First crank section
15 Second crank section
16 Bolt
17 Bearing bolt
18 Recess (bore)
19 Recess
20 Marking
A Axis
B Axis
I First swivel position
II Second swivel position
R1 First direction of rotation
R2 Second direction of rotation

The invention claimed is:

1. A rotary closure for a shoe, especially for a sports shoe, comprising:

a housing which can be attached to the shoe, a tensioning roller which is rotatably supported around an axis in the housing, wherein a tensioning element can be spooled during lacing of the shoe on the tensioning roller and a rotary knob which is arranged rotatably around the axis at the housing to turn the tensioning roller, wherein the rotary closure furthermore comprises:

an intermediate carrier which is arranged rotatably around the axis in the housing, wherein the intermediate carrier comprises at least one pawl which engages in a first blocking gearing which is arranged at or in the housing so that the intermediate carrier can only rotate in one direction of rotation relatively to the housing, at least one locking lever which is arranged in or at the intermediate carrier and which is supported pivoting around an axis which is parallel to the axis in or at the intermediate carrier, wherein the locking lever comprises a locking section which is designed to engage in a second blocking gearing in a first swivel position of the locking lever, which second blocking gearing is arranged at the tensioning roller, and which is further designed not to engage in the second blocking gearing in a second swivel position of the locking lever, wherein a first control element and a second control element are arranged at the rotary knob, wherein the first control element can engage in a first crank section of the locking lever at the rotation of the rotary knob in a first direction of rotation to move the locking lever into the first swivel position and to turn the intermediate carrier together with the tensioning roller, and wherein the second control element can engage in a second crank section of the locking lever at the rotation of the rotary knob in a second direction of rotation which is contrawise to the first direction of rotation to move the locking lever into the second swivel position.

2. The rotary closure according to claim 1, wherein the housing has a cylindrical shape.

3. The rotary closure according to claim 1, wherein the first blocking gearing is formed into an inner circumference of the housing.

4. The rotary closure according to claim 3, wherein the housing consists of plastic material, wherein the first blocking gearing is formed into the material of the housing.

5. The rotary closure according to claim 1, wherein the second blocking gearing and the tensioning roller are formed as a one-piece part, especially as injection moulded part.

6. The rotary closure according to claim 1, wherein the axis for the parts which are movable relatively to the housing is realized by a bolt, especially by a screw bolt.

7. The rotary closure according to claim 1, wherein the tensioning element is a tensioning wire.

8. The rotary closure according to claim 1, wherein the two control elements are formed at the rotary knob as pencil-shaped protrusions, preferably as cylindrical formed protrusions.

9. The rotary closure according to claim 8, wherein the two control elements are arranged at the same diameter from the axis and offset in circumferential direction.

10. The rotary closure according to claim 1, wherein the intermediate carrier comprises two pawls which are arranged at the intermediate carrier diametrically with respect to the axis.

11. The rotary closure according to claim 1, wherein the at least one pawl is arranged as an elastic section radially to the axis at the intermediate carrier.

12. The rotary closure according to claim 11, wherein the pawl extends as substantially straight tongue-shaped section substantially in circumferential direction of the intermediate carrier.

13. The rotary closure according to claim 1, wherein the intermediate carrier consists of a sheet-metal part at which the pawls are formed from the material of the intermediate carrier.

14. The rotary closure according to claim 1, wherein the locking lever consists of metal.

15. The rotary closure according to claim 1, wherein a bearing bolt is arranged at the locking lever protruding in the direction of the axis which is supported in a recess in the intermediate carrier.

16. The rotary closure according to claim 1, wherein a single locking lever is arranged at or in the intermediate carrier.

17. The rotary closure according to claim 1, wherein the rotary knob comprises a recess at a circumferential position eccentrically from the axis, especially a circular shaped recess, and that the intermediate carrier comprises a marking at its side facing the rotary knob, wherein the marking is visible through the recess when the rotary knob is located with its second control element in the second crank section of the locking lever and the locking lever it located thus in the second swivel position.

18. The rotary closure according to claim 17, wherein the marking is designed as a color point.

19. A shoe, especially sport shoe, with a rotary closure according to claim 1.

* * * * *